US009178322B2

(12) United States Patent
Chang et al.

(10) Patent No.: US 9,178,322 B2
(45) Date of Patent: Nov. 3, 2015

(54) ELECTRICAL CONNECTOR HAVING IMPROVED SHIELDING MEMBERS

(71) Applicant: HON HAI PRECISION INDUSTRY CO., LTD., New Taipei (TW)

(72) Inventors: Yen-Chih Chang, New Taipei (TW); Tzu-Yao Hwang, New Taipei (TW); Ke-Hao Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/307,754

(22) Filed: Jun. 18, 2014

(65) Prior Publication Data

US 2014/0377992 A1 Dec. 25, 2014

(30) Foreign Application Priority Data

Jun. 19, 2013 (TW) ..... 102211424

(51) Int. Cl.

| | |
|---|---|
| ***H01R 13/648*** | (2006.01) |
| ***H01R 13/6594*** | (2011.01) |
| ***H01R 13/6585*** | (2011.01) |
| *H01R 12/70* | (2011.01) |
| *H01R 12/71* | (2011.01) |

(52) U.S. Cl.

CPC ..... *H01R 13/6594* (2013.01); *H01R 13/6585* (2013.01); *H01R 12/7082* (2013.01); *H01R 12/716* (2013.01)

(58) Field of Classification Search

CPC ..... H01R 13/6594; H01R 13/6585; H01R 12/7082; H01R 12/716

USPC ..... 439/607.05, 607.08, 607.09, 607.1

See application file for complete search history.

(56) References Cited

U.S. PATENT DOCUMENTS

| | | | | |
|---|---|---|---|---|
| 5,620,340 | A * | 4/1997 | Andrews | 439/607.1 |
| 8,167,652 | B1 * | 5/2012 | Ju | 439/607.13 |
| 8,641,449 | B2 * | 2/2014 | Cai | 439/607.1 |
| 8,932,080 | B2 * | 1/2015 | Chang et al. | 439/607.1 |

FOREIGN PATENT DOCUMENTS

| | | |
|---|---|---|
| TW | M419248 | 12/2011 |

* cited by examiner

*Primary Examiner* — Khiem Nguyen

(74) *Attorney, Agent, or Firm* — Ming Chieh Chang; Wei Te Chung

(57) ABSTRACT

An electrical connector (100) comprises an insulating housing (1) with a plurality of signal contacts (31) and a plurality of grounding contacts (30) received therein, a shielding member (2) and a connecting member (4) set in the insulating housing (1), the shielding member (2) locates around the signal contacts (31), each of the grounding contacts (30) includes a body portion (300), a spring arm (301) extending upwardly from the body portion (300) and a tail portion (302) extending downwardly from the body portion (300), the spring arm (301) includes a contact portion (3010) at the end thereof, the connecting member (4) connects the contact portion (3010) and the tail portion (302) with the shielding member (2).

8 Claims, 6 Drawing Sheets

ELECTRICAL CONNECTOR HAVING IMPROVED SHIELDING MEMBERS

BACKGROUND OF THE INVENTION

1. Field of the Invention

The present invention relates to an electrical connector, and more particularly to an electrical connector having improved shielding members.

2. Description of Related Art

LGA (Land Grid Array) connectors are widely used in electrical field for electrically connecting an IC package with a substrate. Along with the development of the electrical technology, the pads of the IC package and the substrate are set more density. According, the contacts of the LGA connector become more density. In this situation, electromagnetic interference becomes more and more serious which will effect the signal transmission between the IC package and the substrate. Thus, a shielding member is set in the LGA connectors to solve electromagnetic interference problem.

TW patent No. M419248 issued to CHANG on Dec. 21, 2011 discloses a conventional electrical connector. The electrical connector includes an insulating housing with a plurality of contacts received therein and a plurality of shielding members assembled in the insulating housing. The insulating housing includes a top end, a bottom end and a plurality of passageways penetrating the top end and the bottom end. Each of the passageways includes a first passageway and a second passageway. The contacts receive in the first passageways and the shielding members receive in the second passageways. Each of the contacts includes a body portion, an upper spring arm extending upwardly from the body portion, a lower spring arm extending downwardly from the body portion and a retention portion extending from one side of the body portion. The upper spring arm includes a contact portion. The lower spring arm includes a soldering portion. The body portion, the retention portion, the upper spring portion and the lower spring portion locate in the first passageway. Due to the upper spring arm the lower spring arm extending beyond the upper end and the bottom end, but the shielding members locating between the upper end and the lower end, thus, the shielding member can not shielding the whole contact. At the same time, the shielding member disconnects with the IC package and the substrate which will affect the shielding effect.

Hence, it is desirable to provide an improved electrical connector to overcome the aforementioned disadvantages.

SUMMARY OF THE INVENTION

Accordingly, an object of the present invention is to provide an electrical connector having improved shielding member with good shielding effect.

According to one aspect of the present invention, an electrical connector comprises an insulating housing, a plurality of signal contacts and a plurality of grounding contacts received in the insulating housing, a shielding member and a connecting member set in the insulating housing, the shielding member locates around the signal contacts, the grounding contact includes a body portion, a spring arm extending upwardly from the body portion and a tail portion extending downwardly from the body portion, the spring arm includes a contact portion at the end thereof, the connecting member connects the contact portion and the tail portion with the shielding member.

Other objects, advantages and novel features of the invention will become more apparent from the following detailed description when taken in conjunction with the accompanying drawings, in which:

DETAILED DESCRIPTION OF THE INVENTION

Reference will now be made to the drawings to describe the present invention in detail.

Figure 1:
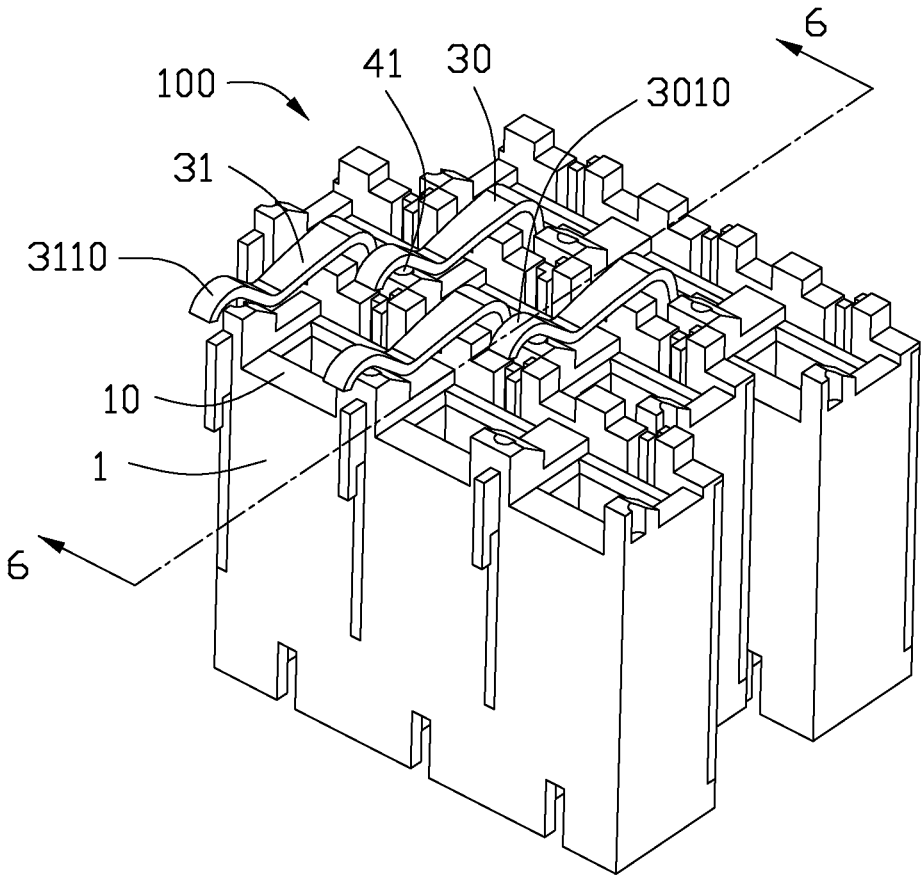
FIG. 1 is an isometric view of the electrical connector according to the present invention.
Figure 2:
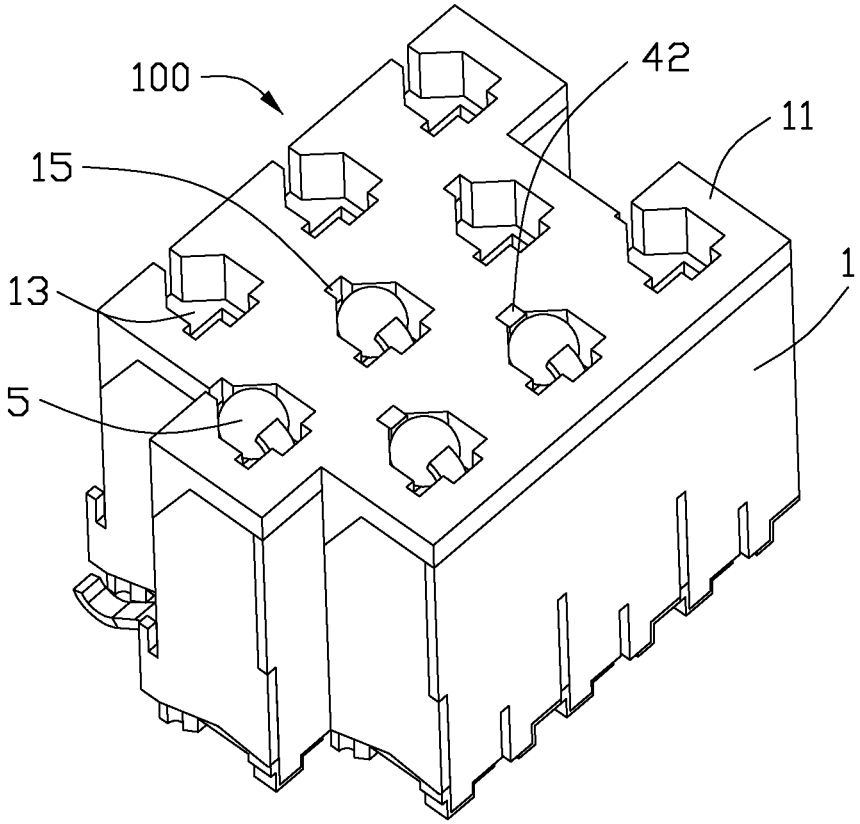
FIG. 2 is another isometric view of the electrical connector according to the present invention.
Figure 3:
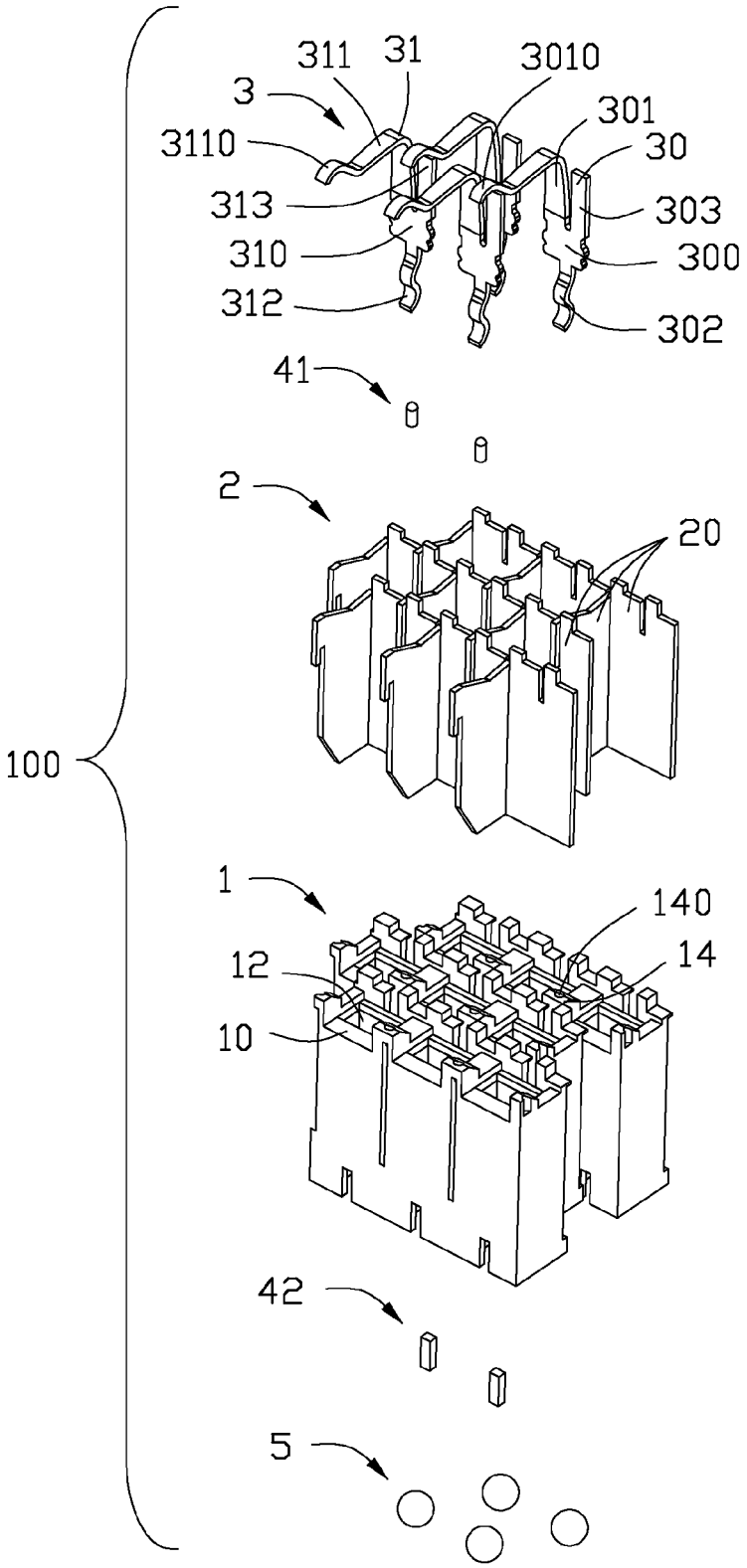
FIG. 3 is an exploded view of the electrical connector as shown in FIG. 1.

Referring to FIGS. 1-3, the electrical connector 100 in accordance to a preferred embodiment of the present invention is used for electrically connecting (not shown) an IC package with a substrate (not shown). The electrical connector 100 includes an insulating housing 1 with a plurality of contacts 3 received therein, a shielding member 2 set in the insulating housing 1 and located around the contacts 3 and a plurality of soldering members 5 assembled to the insulating housing 1. The contacts 3 include signal contacts 31 and grounding contacts 30. The electrical connector 100 further includes a plurality of connecting members 4 for connecting the grounding members 30 and the shielding member 2. In this embodiment, the shielding member 2 is a plurality of metal members 20 assembled together and located around the contacts 3. The shielding member 2 can also be a metal layer coating on the insulating housing 1.

Figure 4:
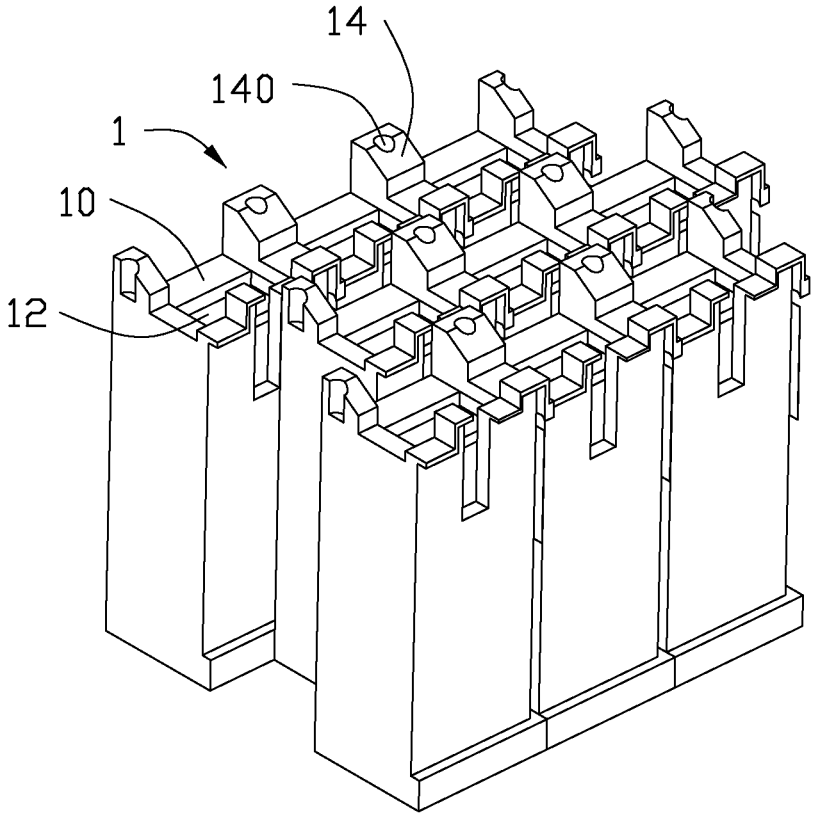
FIG. 4 is an isometric view of the insulating housing as shown in FIG. 3.
Figure 5:
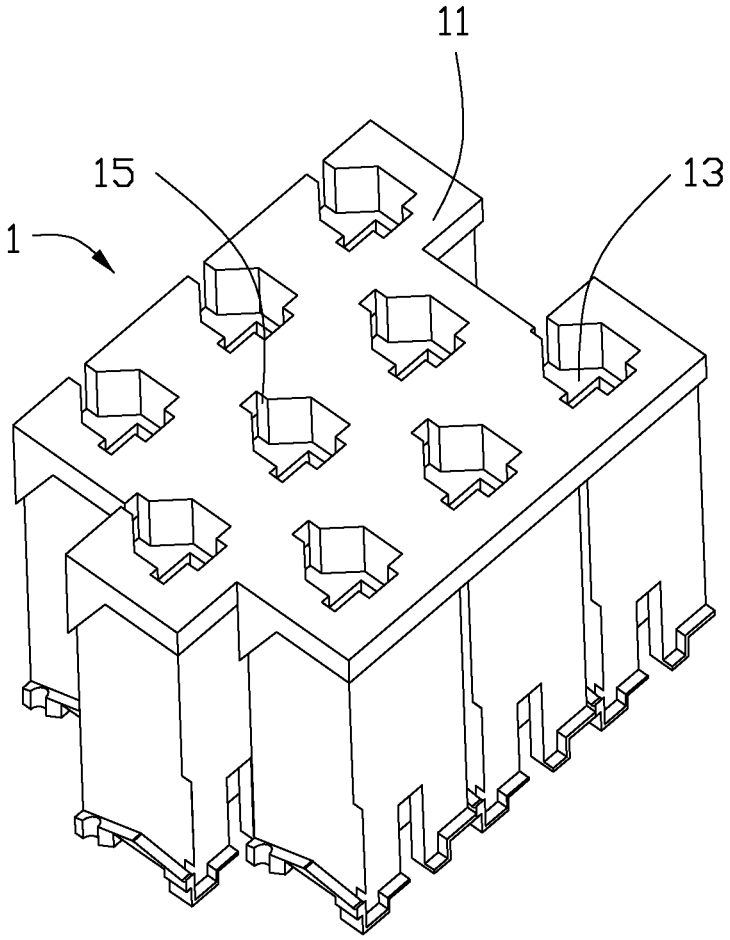
FIG. 5 is anther isometric view of the insulating housing as shown in FIG. 4.
Figure 6:
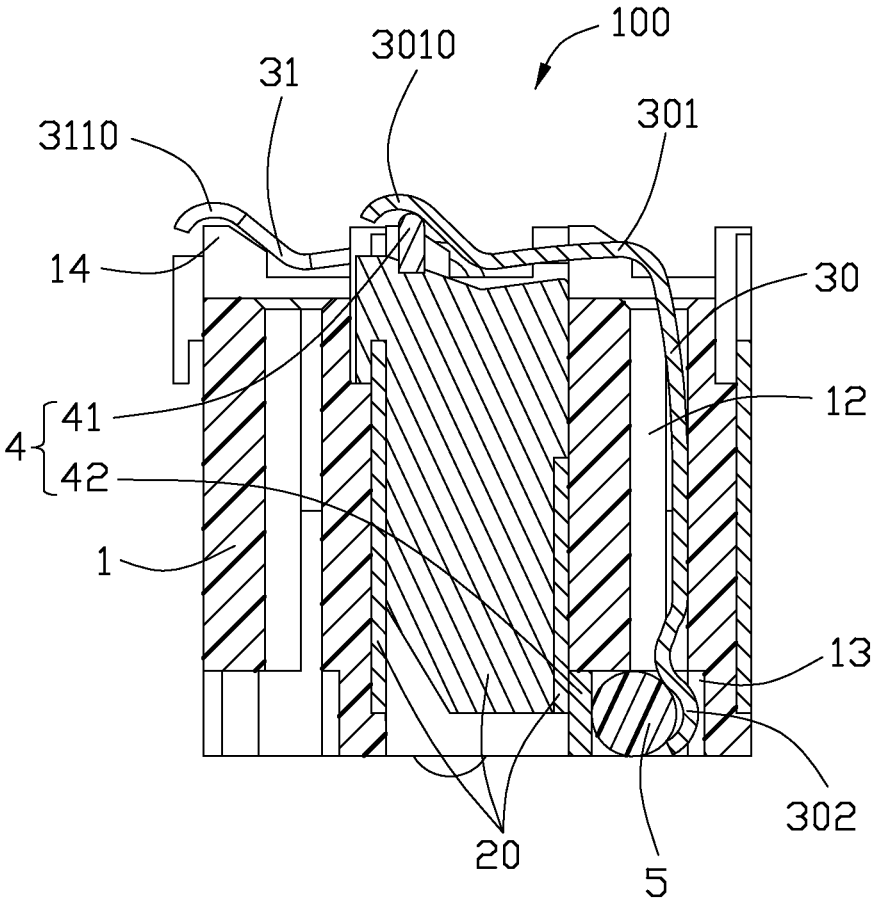
FIG. 6 is a cross-sectional view of the electrical connector along line 6-6 as shown in FIG. 1.

Referring to FIGS. 3-5, the insulating housing 1 is made of insulating material and is configured to a rectangular shape. The insulating housing 1 includes a top surface 10 and a bottom surface 11 opposite to the top surface 10, a plurality of passageways 12 penetrating the top surface 10 and the bottom surface 11. Each of the passageways 12 includes a plurality of recesses 13 recessed from the bottom surface 11 for receiving the soldering members 5. The insulating housing 1 includes a plurality of protruding members 14 extending from the top surface 10 of the insulating housing 1. The protruding member 14 includes a hole 140. The protruding members 14 are set around the passageways 12 and are set in matrix. The insulating housing 1 further includes a plurality of receiving slots 15 recessed from the bottom surface 11 and connected with the recess 13.

Referring to FIG. 3, each of the grounding contacts 30 includes a body portion 300, a spring arm 301 extending upwardly from the body portion 300, a tail portion 302 extending downwardly from the body portion 300, a retention portion 303 extending upwardly from the body portion 300. The spring arm 301 includes a contact portion 3010 at the end thereof. Each of the signal contacts 31 includes a main portion 310, an elastic arm 311 extending upwardly from the main portion 310, a tail portion 312 extending downwardly from the main portion 310, a fixing portion 313 extending upwardly from the main portion 310. The elastic arm 311 includes an engagement portion 3110 at the end thereof.

Each of the connecting members 4 includes an upper connecting member 41 connecting with the contact portion 3010 and a bottom connecting member 42 connecting with the tail portion 302. The upper connecting members 41 are assembled in the holes 140 of the protruding members 14 for connecting the contact portion 3010 with the shielding member 2. The lower connecting members 42 are assembled in the receiving slots 15 for connecting the tail portion 302 with the shielding member 2. Thus, the electrical connector 100 has a good shielding effect. In this embodiment, the soldering member 5 locates between the lower connecting member 42 and the tail portion 302 of the grounding contact 30.

While the preferred embodiments in accordance with the present invention has been shown and described, equivalent modifications and changes known to persons skilled in the art according to the spirit of the present invention are considered within the scope of the present invention as defined in the appended claims.

What is claimed is:

1. An electrical connector, comprising: an insulating housing; a plurality of signal contacts received in the insulating housing; a plurality of grounding contacts received in the insulating housing, the grounding contact including a body portion, a spring arm extending upwardly from the body portion and a tail portion extending downwardly from the body portion, the spring arm including a contact portion at the end thereof; a shielding member set in the insulating housing and located around the signal contacts; and a connecting member set in the insulating housing for connecting the contact portion and the tail portion with the shielding member, wherein the connecting member includes an upper connecting member for connecting the contact portion and the shielding member and a lower connecting member for connecting the tail portion and the shielding member, wherein the insulating housing includes a hole for receiving the upper connecting member and a receiving slot for receiving the lower connecting member, wherein the insulating housing includes a plurality of protruding members located around the signal contacts, the hole is set in the protruding member, wherein the electrical connector further includes a plurality of soldering members assembled in the insulating housing and connecting with the grounding contacts.

2. The electrical connector as claimed in claim 1, wherein the insulating housing includes a plurality of recesses for receiving the soldering members, the recesses connect with the receiving slots.

3. The electrical connector as claimed in claim 1, wherein the soldering member locates between the lower connecting member and the tail portion of the grounding contact.

4. The electrical connector as claimed in claim 1, wherein shielding member is plurality of metal members assembled together and located around the signal contacts.

5. An electrical connector, comprising: an insulating housing; a plurality of signal contacts received in the insulating housing; a plurality of grounding contacts received in the insulating housing, the grounding contact including a body portion, a contact portion extending upwardly from the body portion and a tail portion extending downwardly from the body portion; a shielding member set in the insulating housing and located around the signal contacts; and a connecting member set in the insulating housing for connecting the contact portion and the tail portion with the shielding member, wherein the connecting member includes an upper connecting member for connecting the contact portion and the shielding member and a lower connecting member for connecting the tail portion and the shielding member, wherein the insulating housing includes a hole for receiving the upper connecting member and a receiving slot for receiving the lower connecting member, wherein the insulating housing includes a plurality of protruding members located around the signal contacts, the hole is set in the protruding member, wherein the electrical connector further includes a plurality of soldering members assembled in the insulating housing and connecting with the grounding contacts.

6. The electrical connector as claimed in claim 5, wherein the insulating housing includes a plurality of recesses for receiving the soldering members, the recesses connect with the receiving slots.

7. The electrical connector as claimed in claim 5, wherein the soldering member locates between the lower connecting member and the tail portion of the grounding contact.

8. An electrical connector comprising: a plurality of shielding plates intersecting with one another along a row direction and a column direction which are perpendicular to each other; an insulative housing unitarily formed with said shielding plates via an insert molding process, said housing forming opposite upper and bottom surfaces in a vertical direction and a plurality of receiving cavities therebetween with a grid structure along said row direction and said column direction; and a plurality of signal contacts and a plurality of grounding contacts disposed in the corresponding receiving cavities, respectively; wherein each of said grounding contacts mechanically and electrically connects to the corresponding shielding plate via at least one conductive element around at least one of the upper and bottom surfaces of the housing, wherein each of said grounding contacts mechanically and electrically connect to the corresponding shielding plate around both said upper and bottom surfaces of the housing, wherein the receiving cavities are arranged in an offset manner between every adjacent row direction or column direction, wherein each of the grounding contacts includes a resilient arm to connect to said conductive element, wherein each of said grounding contacts is equipped with a solder ball around the bottom surface of the housing.

* * * * *